United States Patent [19]

Rasmussen

[11] Patent Number: 4,603,510

[45] Date of Patent: Aug. 5, 1986

[54] MULTIPLE POSITION BELT GRINDER

[76] Inventor: Aaron P. Rasmussen, 9606 Candy La., La Mesa, Calif. 92041

[21] Appl. No.: 644,392

[22] Filed: Aug. 27, 1984

[51] Int. Cl.[4] ..... B24B 21/20

[52] U.S. Cl. ..... 51/148; 51/135 R; 51/147; 51/238 R

[58] Field of Search ..... 51/135 R, 135 BT, 141, 51/147, 148, 170 EB, 238 R, 262 R, 266; 474/114, 136

[56] References Cited

U.S. PATENT DOCUMENTS

| | | | |
|---|---|---|---|
| 809,254 | 1/1906 | Golden | 51/238 R X |
| 2,087,241 | 7/1937 | Bunker | 51/135 R X |
| 2,199,069 | 4/1940 | Fowler | 51/170 EB X |
| 2,489,811 | 11/1949 | Perkins | 51/147 X |
| 2,507,372 | 5/1950 | Emmons | 51/135 R |
| 2,560,102 | 7/1951 | Guinn | 51/170 EB X |
| 2,562,229 | 7/1951 | Bell | 51/266 X |
| 2,857,726 | 10/1958 | Smith | 474/114 X |
| 3,110,989 | 11/1963 | Dawson et al. | 51/135 R |
| 3,438,154 | 4/1969 | Vichi | 51/135 R |
| 3,523,470 | 8/1970 | Miller | 474/114 X |
| 4,316,349 | 2/1982 | Nelson | 51/135 R |

*Primary Examiner*—Robert P. Olszewski
*Attorney, Agent, or Firm*—Charles C. Logan, II

[57] ABSTRACT

The belt grinder provides a variety of vertical and horizontal position grinding options. The three wheel machine head features an offset axial mount, counterbalanced to rotatably elevate selected work stations. Total revolution of the machine head through 360 degrees produces six distinctive stations to accommodate diverse grinding requirements. The drive motor is mounted centrally within the machine head assembly and it has a drive shaft extending into the V-belt housing. One of the three wheels in the machine head is the drive wheel and it has a drive shaft also extending into the V-belt housing. Step pulleys are mounted on these respective drive shafts to give the belt grinder a speed change capacity. Tension on the abrasive belt and the V-belt is applied or released in incremental order with the revolution of a leveraged step cam. Articulation between two spring loaded idler wheels in the machine head insures synchronous tension, eliminates slack belt slap, and maintains consistent belt line geometry. The belt grinder has a tubular platen that interfaces with the drive wheel which is helically serrated and they function to generate a centrifugal air flow through the platen interior. This design feature moderates the heat build generated by belt friction on the platen surface. The machine also has a system of dual purpose work rests that support the work piece and adjust to guard "at rest" work stations. Other hardware on the machine functions to evaluate machine dust, adjust V-belt and abrasive belt tension and adjust belt tracking camber.

15 Claims, 29 Drawing Figures

FIG. 6
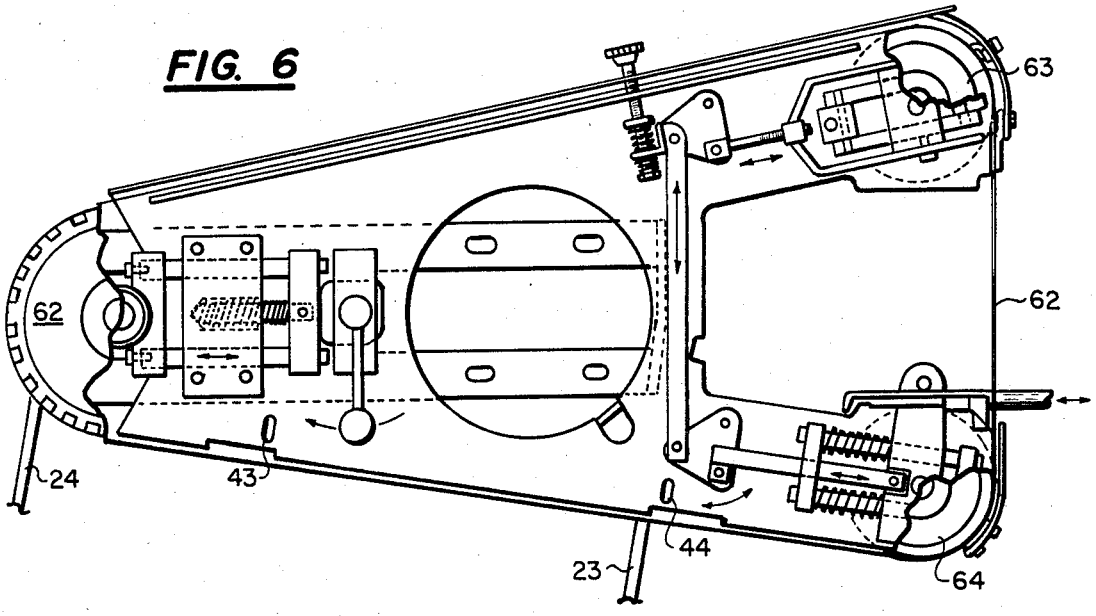
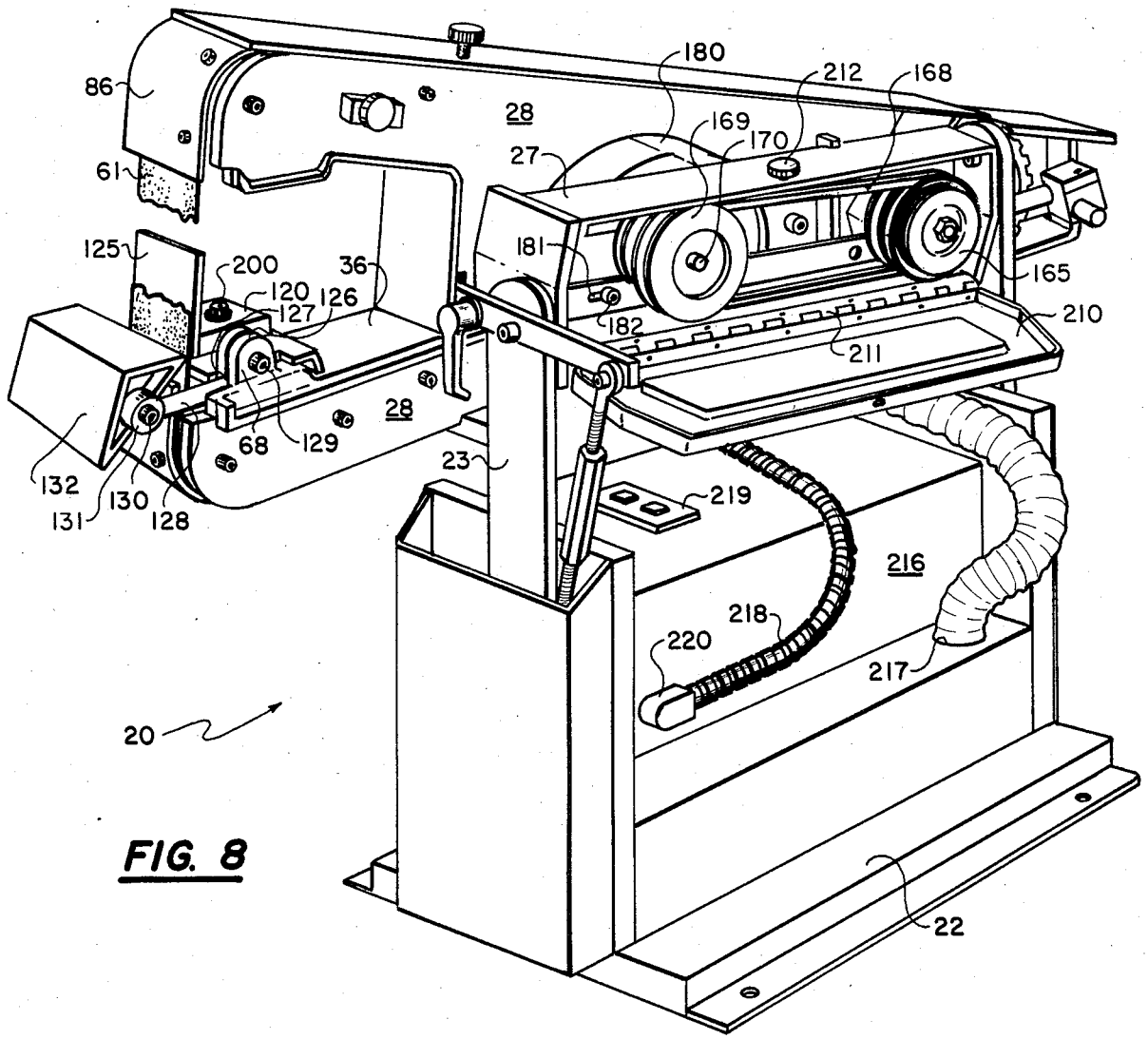
FIG. 8

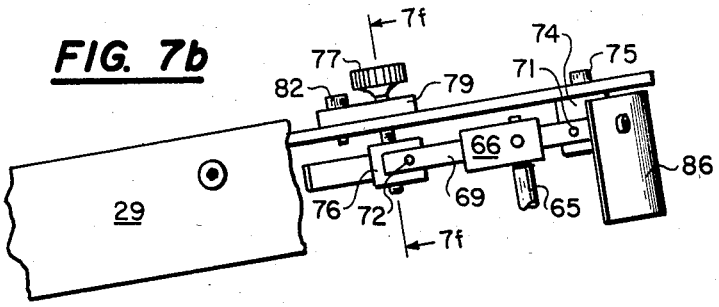
FIG. 7b
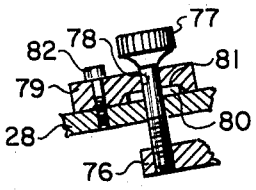
FIG. 7f
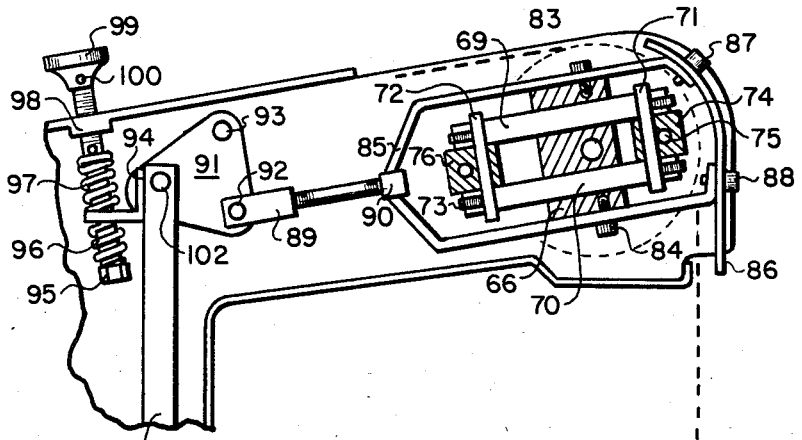
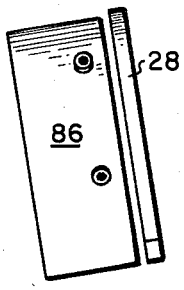
FIG. 7d
FIG. 7a
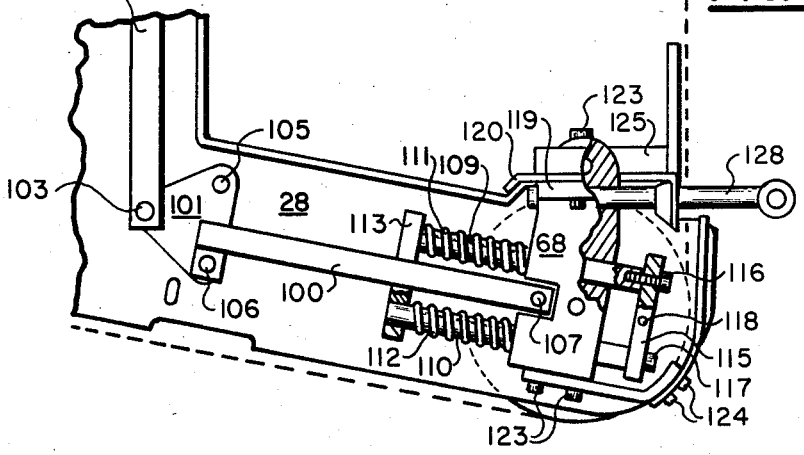
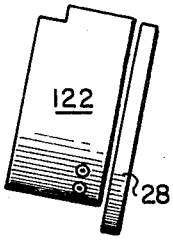
FIG. 7e
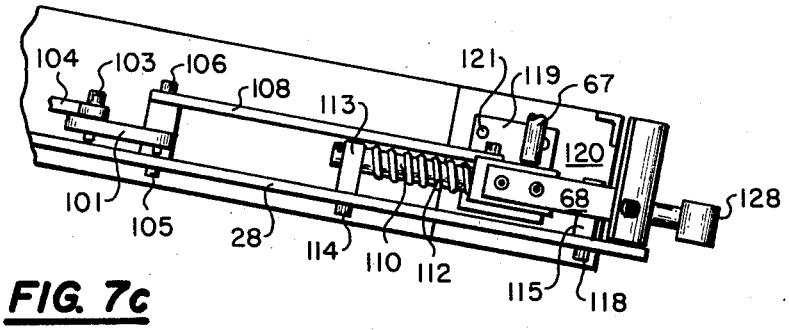
FIG. 7c FIG. 11a
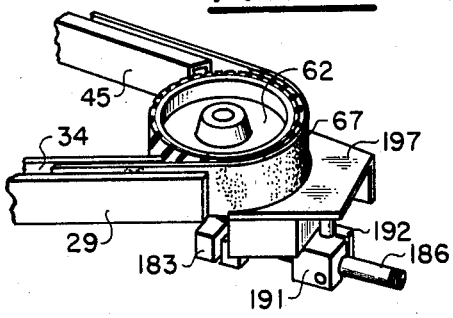
FIG. 11b
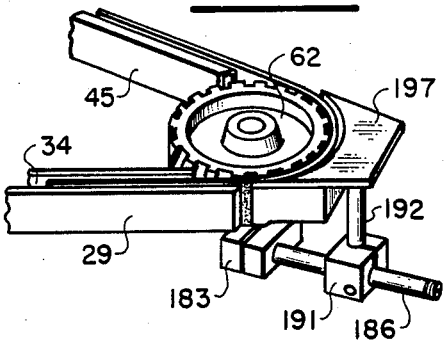
FIG. 11c
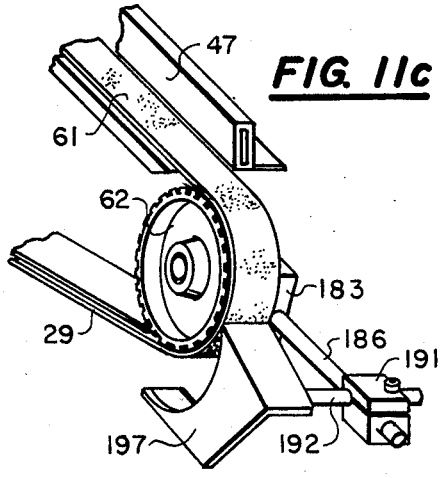
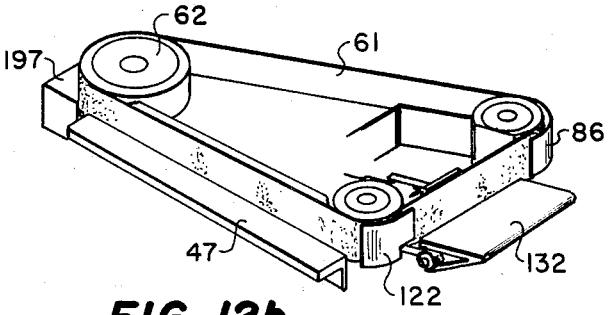
FIG. 12b
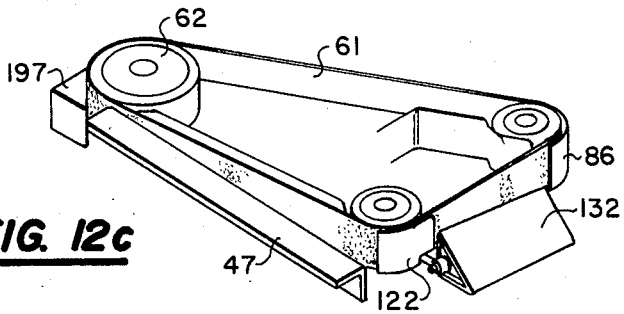
FIG. 12c
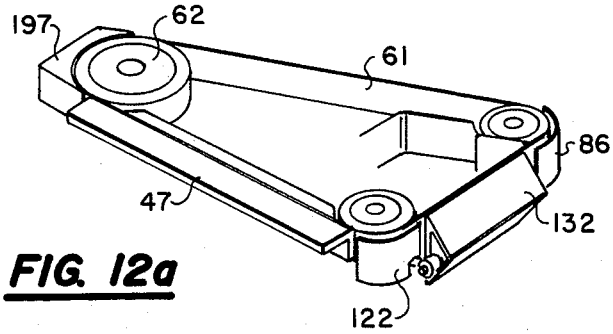
FIG. 12a

MULTIPLE POSITION BELT GRINDER

BACKGROUND OF THE INVENTION

The present invention relates to belt grinders and more particularly to a multiple position belt grinder offering exceptional work station versatility and featuring design structure unique from existing abrasive machinery.

In the past prior art belt grinders have not addressed adequately the industrial requirements for alternate horizontal and vertical performance, differential belt speeds, improved operator accessibility and platen heat control.

It is an object of the invention to provide a novel three wheeled abrasive belt grinder offering open throat, contact wheel, and long platen work stations operable in vertical or horizontal planes.

It is also an object of the invention to provide a novel three wheeled abrasive belt grinder whose machine head assembly has a counterbalanced axial mount and locking mechanism for revolution of the machine head through its operational planes.

It is also an object of the invention to provide a novel three wheeled abrasive belt grinder which improves human engineering factors by offsetting the machine head relative to the axial mount, with this offset feature designed to elevate specified work stations to advantageous operating positions.

It is also an object of the invention to provide a novel three wheeled abrasive belt grinder having a balanced "on board" power source and a simple speed change drive consonant with the moveable machine head concept of the belt grinder.

It is also an object of the invention to provide a novel three wheeled abrasive belt grinder which has structure to produce staged release of the abrasive belt or the V-drive belt by means of a bar slide machanism and step cam controlled with a single leveraged bar.

It is also an object of the invention to provide a novel three wheeled abrasive belt grinder which applies spring tension to both idler wheel members thereby reducing slack belt slap at the trailing edge of the drive wheel.

It is also an object of the invention to provide a novel three wheeled abrasive belt grinder having connective linkage to articulate the reciprocating movement of the idler wheels on their respective slide mounts. The linkage insures contiguity of the belt line with support platens irregardless of belt length adjustment.

It is also an object of the invention to provide a novel three wheeled abrasive belt grinder which will limit the danger of tension spring failure. Dislocation problems and belt tension are controlled by means of an adjustor attached to the idler connective linkage.

It is also an object of the invention to provide a novel three wheeled abrasive belt grinder having a belt tracking mechanism capable of transmitting camber adjustment to reciprocating idler wheel assembly.

It is also an object of the invention to provide a novel three wheeled abrasive belt grinder having work rests and guards that attach to and have synchronous movement with the wheel assemblies and wherein these rests and guards maintain adjustment irrespective of belt stretch.

It is another object of the invention to provide a novel three wheeled abrasive belt grinder having multiple position work rests that support the work piece in vertical and horizontal orientation and that are adjustable to fully guard "at rest" work stations.

It is an additional object of the invention to provide a novel three-wheeled abrasive belt grinder having structure to ventilate the long platen to reduce frictional heat buildup. A helically serrated drive wheel, an abrasive belt and tubular platen are arranged to form a standard component pump, eliminating the need for a retrofit hardward.

It is a further object of the invention to provide a novel three wheeled abrasive belt grinder having a structure which insures a distributive collection of abrasive dust. Spaced holes bored in the side wall of the vacuum evacuated tubular work rest provides excellent belt proximity and eliminates additional collector tubes.

DESCRIPTION OF THE DRAWING

FIG. 6 is an interior view depicting the working relationship of the respective machine head parts;

FIG. 7*a* is a partially sectioned enlargement of the idler wheel assemblys end connective linkage;

FIG. 7*b* is an orothographic representation of the upper yoke member of FIG. 7*a;*

FIG. 7*c* is an orothographic representation of the lower yoke member of FIG. 7*a;*

FIG. 7*d* is an end profile view of FIG. 7*b;*

FIG. 7*e* is an end profile view of FIG. 7*c;*

FIG. 7*f* is a cross sectional view taken along lines F—F' of FIG. 7*b;*

FIG. 8 is a perspective view as seen from the right side illustrating the drive train components;

FIGS. 11*a*, 11*b*, and 11*c* illustrate options for positioning the contact wheel work rest; and FIG. 12*a*, 12*b*, and 12*c* illustrate options for positioning the long and short platen work rests.

DESCRIPTION OF THE PREFERRED EMBODIMENT

Figure 1C:
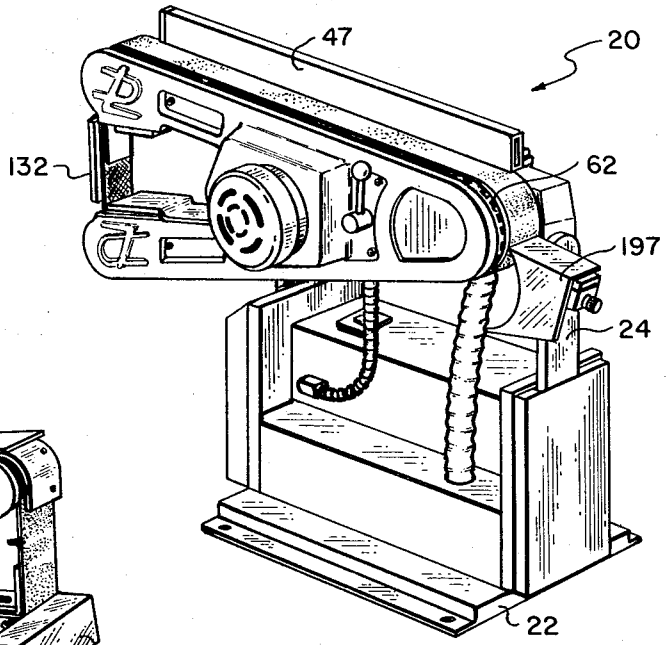
FIG. 1*c* is a perspective view as seen from its right side with the machine head in the vertical position which produces an slevated contact wheel work station.
Figure 1B:
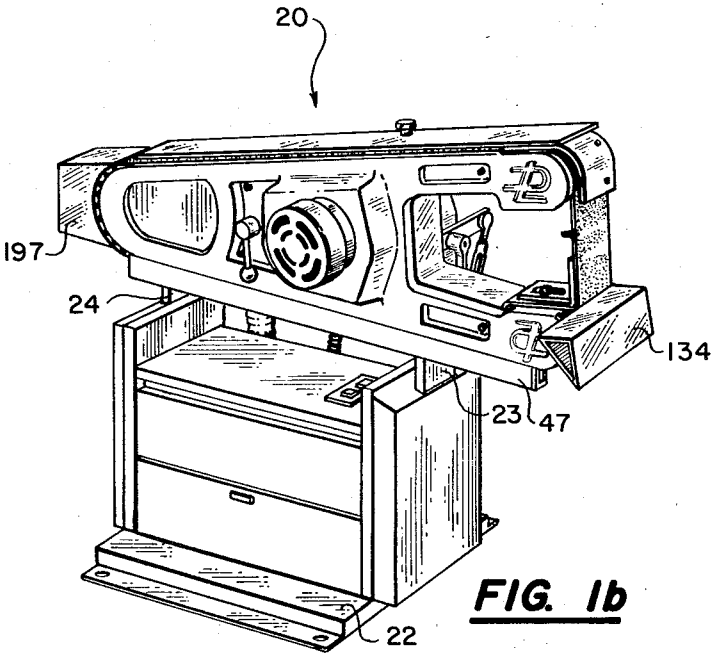
FIG. 1*b* is a perspective view as seen from its left side with the machine head in the vertical position which produces an elevated yoke work station.
Figure 1A:
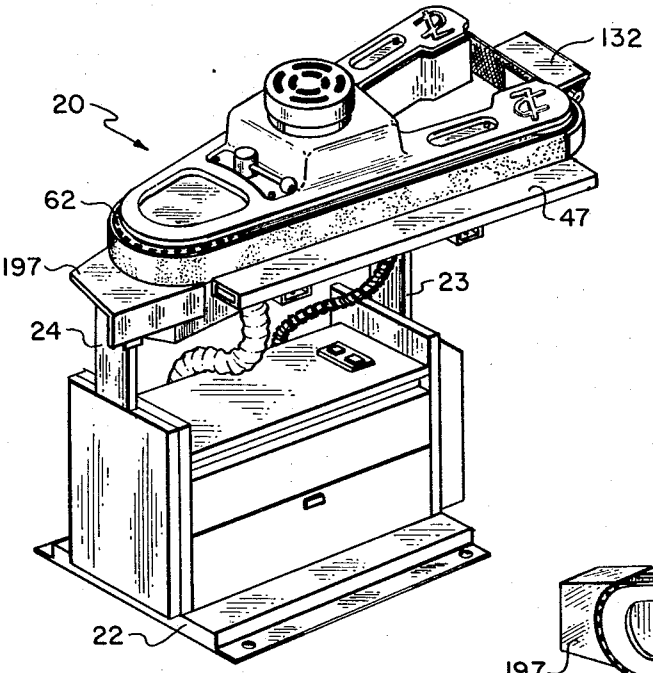
FIG. 1*a* is a perspective view of the preferred embodiment of applicant's novel multiple position belt grinder as seen from its left side in the horizontal machine head position.

Applicant's novel multiposition belt grinder will be described by referring to FIGS. 1–12 of the drawings. The multiple position belt grinder is generally designated numeral 20. In FIGS. 1*a–c*, belt grinder 20 is illustrated in its various horizontal and vertical positions.

Figure 4A:
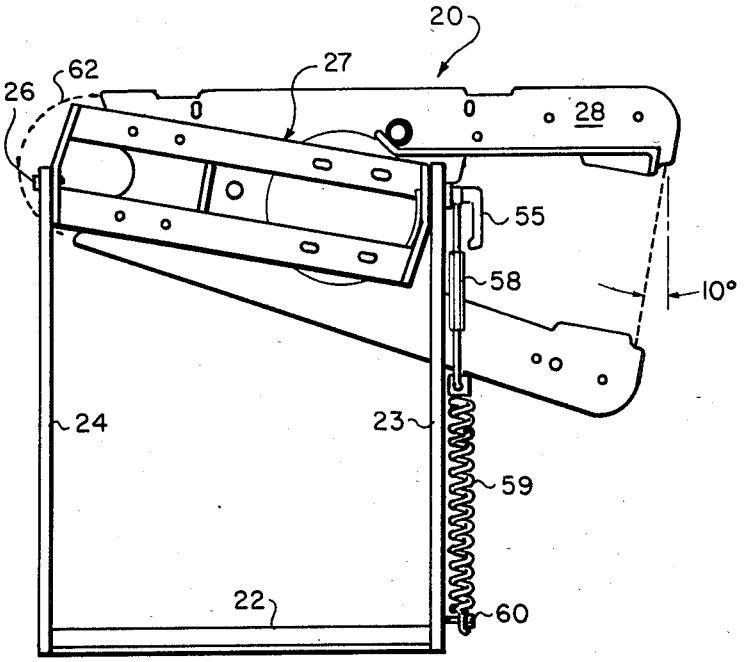
FIG. 4*a* is a left side skeletal view with the machine head in a vertical position which produces an elevated contact wheel work station.
Figure 4B:
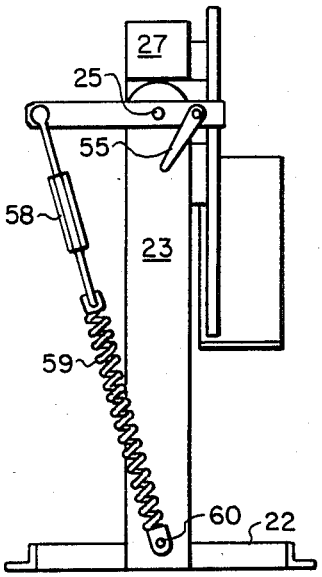
FIG. 4*b* is an orthographic front view of FIG. 4*a;*

Referring to FIG. 4*a* and 4*b*, belt grinder 20 has a base stand 22 having an upwardly extending rear support bar 23 and an upwardly extending rear support bar 24. Shoulder bolts 25 and 26 pivotally carry V-belt housing 27 is a bottom frame member 28.

Figure 2:
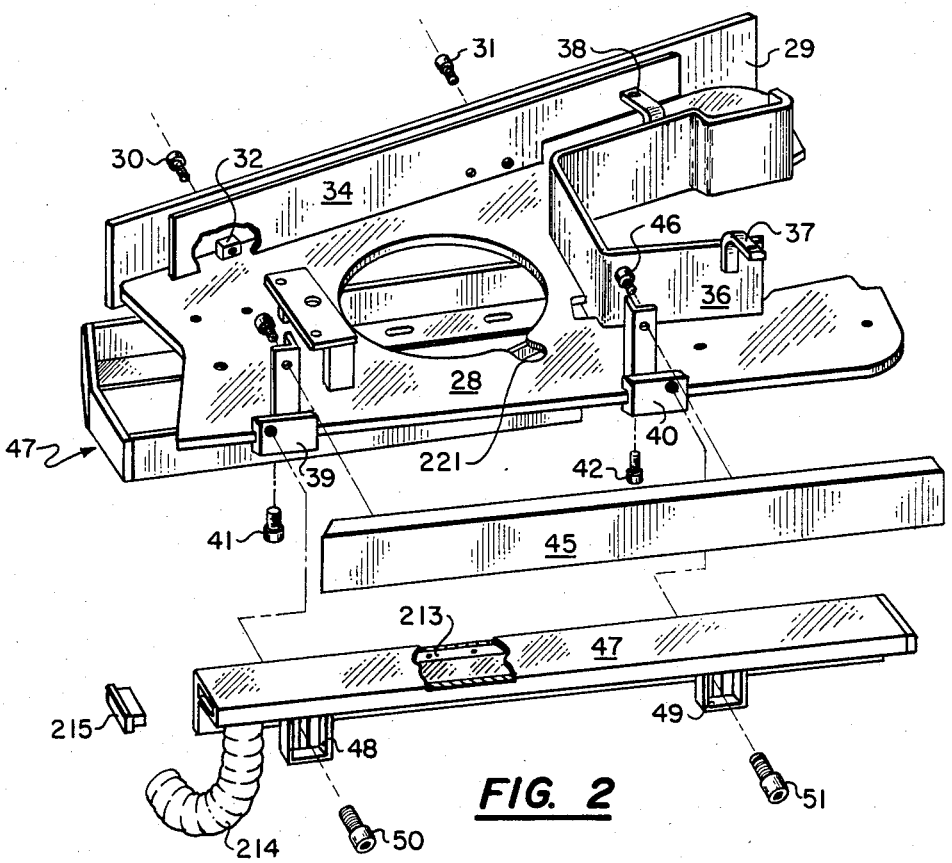
FIG. 2 is a perspective skeletal view of the machine head components.

In FIG. 2, bottom frame member 28 is shown in weldment to panel 29 and other skeletal framework. Capscrews 30 and 31 penetrate panel 29 and spacers 32 to clamp belt sheath 34 in place. Also attached to frame 28 is and yoke shroud 36 to which cover tabs 37 and 38 are welded. Standards 39 and 40 are fastened to frame 28 with capscrews 41 and 42 which penetrate adjustment slots 43 and 44 (see FIG. 6) to thread into their respective standard. Long platen 45 is fixedly mounted to the standards by four capscrews, exemplified by capscrew 46. Worktable 47 is adjustably attached to the standards through slotted table brackets 48 and 49 by capscrews 50 and 51.

Figure 3B:
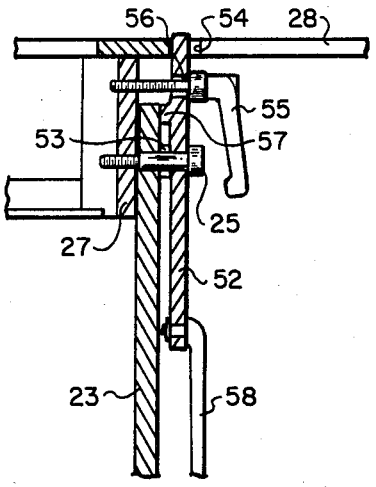
FIG. 3*b* is an enlarged cross section taken along lines D-D' of FIG. 3*a* illustrating structure for rotating the machine head.
Figure 3A:
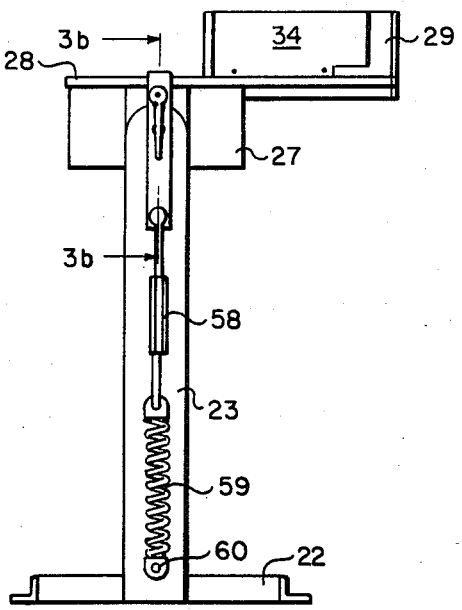
FIG. 3*a* is a front profile view of the structural members supporting the machine head.

The manner in which the machine head assembly is pivotally supported on support bars 23 and 24 is illustrated in FIG. 3*b*. Also shown is the structure for locking the machine head assembly in any desired angular orientation. Shoulder bolt 25 is shown penetrating leverage arm 52, housing washer 53 and yoke support bar 23 to thread into V-belt housing 27, to effect a pivot. Leverage arm 52 is contained and rotationally controlled in frame slot 54. Adjustable handscrew 55 passes through clearance hole 56 and threads into housing 27 to exert frictional pressure on leverage pad 57 and lock the machine head assembly in any desired selected angle. Leverage arm 52 is connected to turnbuckle 58 which is tensioned by spring 59 that is anchored to the base of yoke support bar 23 with welded pin 60. The relationship of the interior head component is illustrated in FIG. 6. The travel line of belt 61 is shown supported by drive wheel 62, camber idler wheel 63 and platen idler wheel 64. Idler wheel 63 is bearing mounted on shouler bolt 65 (see FIG. 7*b*) which threads into cam carrier block 66. Idler wheel 64 is bearing mounted on shoulder bolt 67 (see FIG. 7*c*) which threads into platen carrier block 68.

The articulated idler wheel assembly is best understood by referring to FIGS. 7*a–f*. Carrier block 66 slides on carrier rods 69 and 70 which are bored at their ends to receive pivot pins 71 and 72. Four set screws, exemplified by set screw 73 lock the pivot pins in place. Pivot pin 71 rotatably pivots on and is position located on frame block 74, which in turn is locked to the frame in threaded fashion with capscrew 75. Pivot pin 72 rotatably pivots on camber block 76 which is threaded to receive adjustor screw 77 (shown in the enlarged section in FIG. 7*f*). Adjustor screw 77 rotates in bore hole 78 of adjustor block 79 and is laterally contained by snap ring 80, residing in spotface 81. Finally, adjustor block 79 is anchored to frame 28 in a threaded fashion by capscrew 82.

In FIG. 7*a*, carrier block 66 is coupled by shoulder bolts 83 and 84 to Y-linkage 85. The extension of linkage age 85 is fitted to carry wheel shield 86 by means of capscrews 87 and 88. Adjustor 89 threads into boss 90 of Y-linkage 85 and connects that linkage with pivot arm 91 by shoulder 92. Pivot arm 91 rotates in fixed location on shoulder bolt 93 which threads into frame 28.

Tensioner angle 94 is weldment attached to connector bar 104 and is bored to receive spring loaded capscrew 95 tensioned between springs 96 and 97. Capscrew 95 threads through boss 98 of panel 29 and helically adjusts pivot arm 91 by means of thumb wheel 99 locked on capscrew 95 by setscrew 100.

Motion is transmitted from pivot arm 91 to pivot arm 101 by shoulder bolts 102 and 103 at the terminal ends of connector bar 104. Pivot arm 101 rotates into frame 28 as shown in FIG. 7*a* and 7*b*.

Motion from pivot arm 101 is transmitted to carrier block 68 with offset bar 108 secured by shoulder bolts 106 and 107. Carrier block 68 slides on carrier rods 109 and 110 and is spring tensioned by springs 111 and 112. Carrier rods 109 and 110 are fitted into bored holes in frame block 113 which is attached to frame 28 by capscrew 114. The opposing ends of carrier rods 109 and 110 are end bolted to frame 115 by capscrew 116 and 117. Block 115 is fastened to frame 28 by capscrew 118.

In FIGS. 7*a* and 7*b* carrier block 67 supports sub plate 119, which in turn is fitted to accept cover plate 120 fixed with plug weld 121. At its base, carrier block 68 supports wheel shield 122 by four cap screws 123 and 124.

An enlarged view of the platen yoke member is illustrated in FIG. 8. Moveable and slotted platen 125 is bolted down to table 110 by capscrew 200. Also shown is kerf 126 and bore 127 of carrier block 68 which telescopically receives tool post 128. Toolpost 128 is adjustably gripped in position by capscrew 129. Capscrew 130 penetrated tool post bore 131 to thread into throat work rest 132.

Figure 9C:
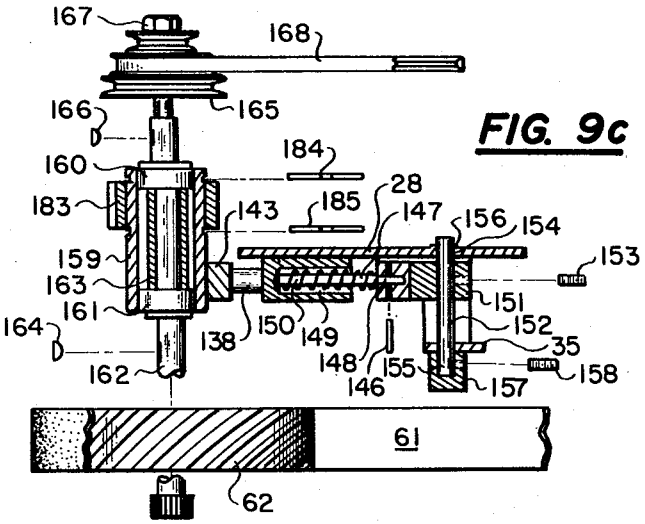
FIG. 9*c* is a partially sectioned view taken along lines C—C' of FIG. 9*a;*
Figure 9A:
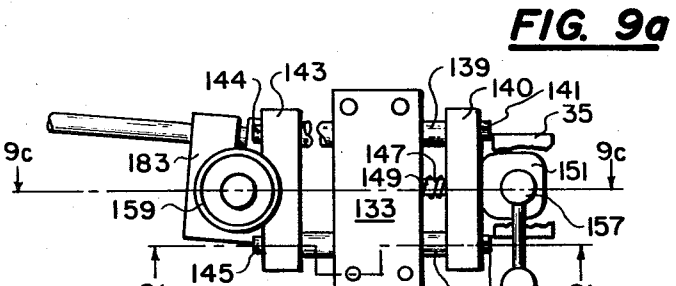
FIG. 9*a* is an orothographic view of the drive member and belt release components.

FIG. 9*a* with partially sectioned views 9*b* and 9*c* represent the mechanism of the drive wheel assembly. Frame block 133 is fixed to frame 28 by four capscrews 134. These capscrews pass through frame 28 and thread into that portion of block 133 located below kerf 135, but continue through clearance hole 136 to receive four lock nuts 137. Lock nut 137 is adjustable to regulate the sliding fit of rods 138 and 139 in block 133. Telescoping bars 138 and 139 are attached at one end to cam block 140 by threaded capscrews 141 and 142 and at their opposing ends to axle block 143 by threaded capscrews 144 and 145. A pin 146 secures spring rod 147 in bore 148 of cam block 140, which with spring 149, clearance fit within bore 150 of frame block 133. Bearing on cam block 140 is step cam 151, which is fixed to cam axle 152 by set screw 153. Cam axle 152 is in running fit within bore 154 of frame 28 and bore 155 of crank support 35. Lineal motion is contained at one end by snap ring 156 and at the other en by cam handle 157, which is fixed in position by set screw 158.

Axle housing 159 is welded in fixed position to axle block 143. Bearing 160 and 161 carry drive axle 162 and spacer 163. Axle 162 supports drive wheel 62 which is locked in position by key 164. At its opposite end, axle 162 is fitted step pulley 165 by key 166 and nut 167. Step pulley 165 is powered by V-belt 168 shown in FIG. 8 by step pulley 169 which is attached to drive shaft 170 of drive motor 180. Drive motor is adjustably mounted to belt housing 27 through four slots 181 by four capscrews 182 that screw into C-faced drive motor 180. Referring to FIGS. 9*a* and 9*c*, split clamp 183 is retained in lateral position by snap rings 184 and 185.

Figure 10A:
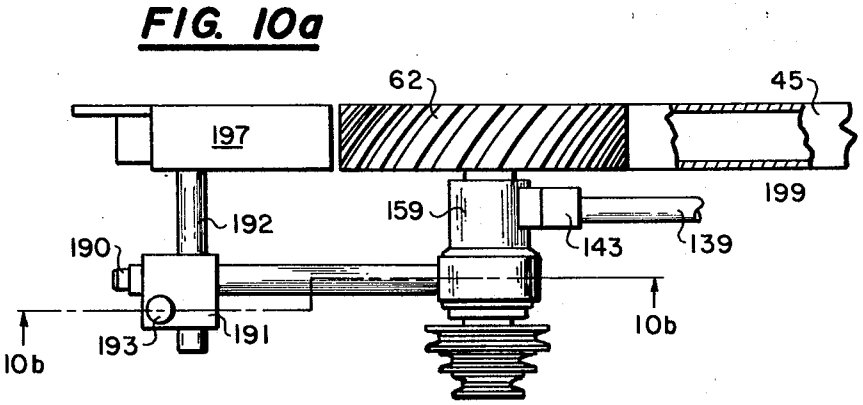
FIG. 10*a* is a top view of the contact wheel, work rest assembly and air pump.
Figure 10B:
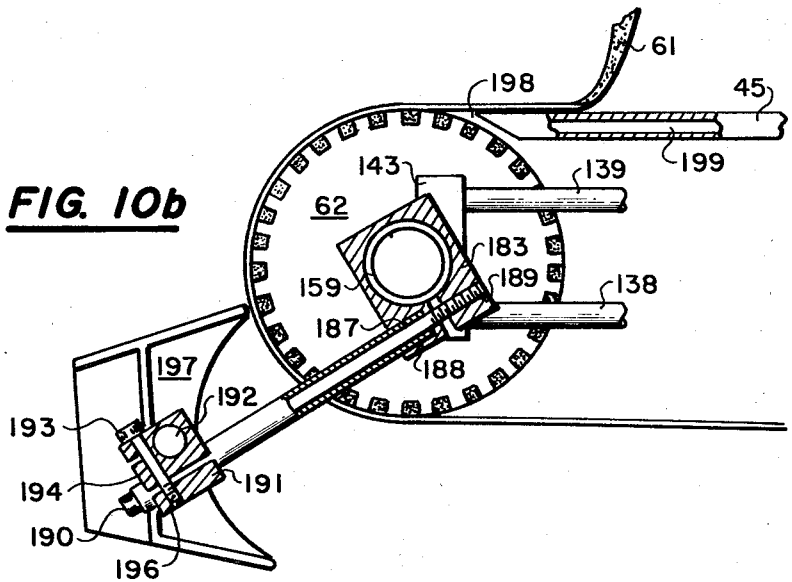
FIG. 10*b* is a partially sectioned view taken along lines A—A' of FIG. 10*a;*

A top and partially sectioned side view of the contact rest assembly is illustrated in FIGS. 10*a* and 10*b*. Sleeve 186 is set in counterbore 187 of split clamp 183. Penetrating the bore of sleeve 186 and clearance hole 188 to engage threads 189 in split clamp 183 is capscrew 190 which functions to lock the clamp in position. Rest clamp 191 is used to adjustably lock tool post 192 in selected position by capscrew 193 which extends through clearance hole 194 to enage threads 196. Attached by weldment to tool post 192 is contact work rest 197.

Also shown in FIGS. 10*a* and 10*b* is the structure for cooling long platen 199. Serrated drive wheel 62, in concert with abrasive belt 61, generate a helical high pressure area at pressure point 198 causing air flow through platen 45 as shown at flow point 199.

FIGS. 11*a–c* through 12*a–c* all illustrate adjustment of machine work rests for specific applications. FIG. 11*a* represents work rest 197 in a horizontal contact wheel position. FIG. 11*c* represents rest 197 in a vertical contact wheel position and FIG. 11*b* illustrated rest 197 employed as a safety guard for contact wheel 62.

FIG. 12*b* represents worktable 47 in full platen position and workrest 132 in full throat position. FIG. 12*c* illustrates worktable 47 in a diagonal platen position and workrest 132 in a diagonal inclined position. FIG. 12*a* illustrates worktable 47 and workrest 132 in fully guarded positions. One other figure illustrates an additional workrest position, that being FIG. 8 which shows workrest 132 in a vertical orientation.

OPERATION

Applicant's novel invention relates to a multiple position belt grinder operable in vertical and horizontal planes. As seen in FIG. 4*a*, the belt grinder has a base stand 22 support bars 23 and 24 extending upwardly therefrom. V-belt housing 27 is pivotally mounted between the support bars and it functions to house the drive assembly and support main frame 28.

Figure 5B:
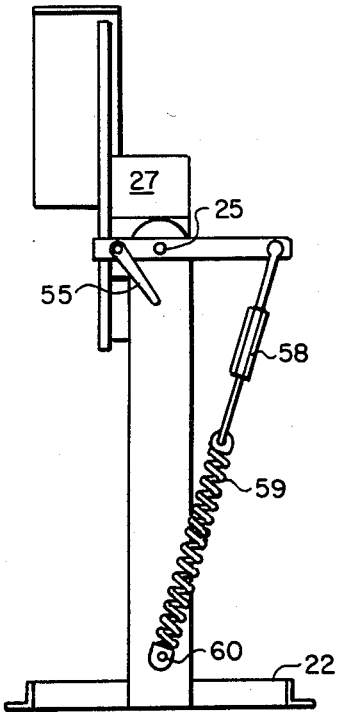
FIG. 5*b* is an orothographic front view of FIG. 5*a;*
Figure 5A:
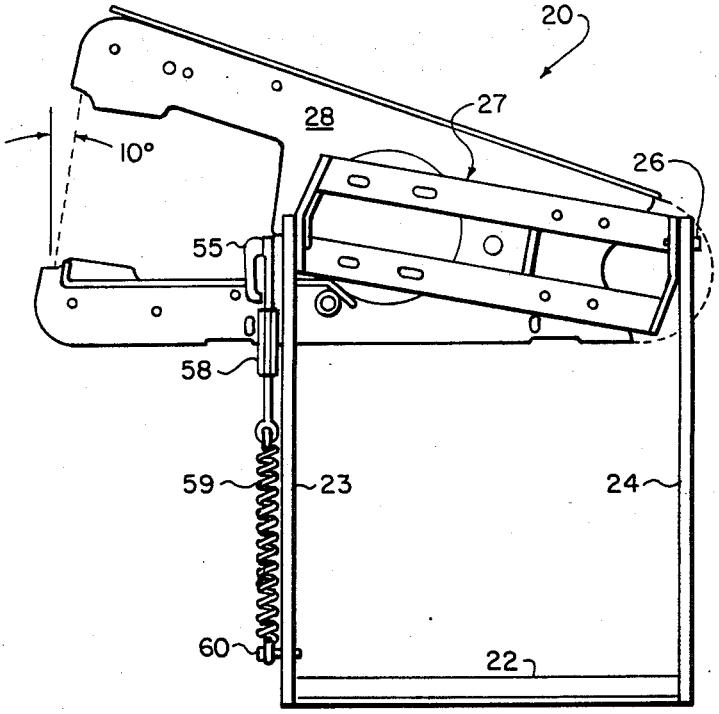
FIG. 5*a* is a right side skeletal profile with the machine head in a vertical position which produces an elevated yoke work station.

V-belt housing 27 is illustrated in FIG. 4*a* as being hexagonal in shape. The center line of V-belt housing 27 and frame 28 is offset from the axial line of pivot as represented by shoulder bolt 25 on support bar 23 and shoulder bolt 26 on support bar 24. This offset mount produces elevation of different sections of the machine during lateral rotation. FIG. 4*a* illustrates elevation of contact wheel 62. FIG. 4*b* shows the correlary front position and indicates the counterbalance structure. When the machine head assembly is in a vertical orientation at either side of support bar 23, spring 59 provides a counterforce enabling the operation to easily swing the machine head through its 360 degree range. Adjustment of spring tension is accomplished with turnbuckle 58. FIG. 5*a* indicates an elevated yoke position with operator access to the throat. FIG. 5*b* shows a frontal profile view of position 5*a*.

FIGS. 1*a–c* should be referred to for a discussion of the offset concept as it related to operating efficiency. In the present invention, the advantage of multiple work stations is made possible through the rotation of various belt segments to accessible operator positions. In FIG. 1*a*, with the machine head in a horizontal position, work stations are visible at contour workrest 197, at long workrest 47, FIG. 1*b* illustrates the machine head in the left side vertical position with two stations guarded. The advantage in this position, is an open throat work station with an elevated and inclined presentation angle at yoke workrest 132. FIG. 1*c* shows the machine head in the right angle vertical position with guarded yoke station 132. Working stations in this orientation feature an elevated wheel contact surface at contour rest 197, and an edge grinding surface along worktable 47 which is, in this orientation, parallel with the floor. Long abrasive belts have a tendency to slap at the trailing edge, slack side of the drive wheel. FIG. 7 suggests an improved tensioning structure wherein idler wheels 63 and 64 are coupled with connective linkage to reduce aberation and stablilze running characteristics. Articulation linkage has another important function. It is essential that the idler wheels move in unison to provide a continuous belt line geometry. The later consideration is necessary to minimize adjustment to platens and guards when belt dimensions vary and tension is adjusted.

Relating to the connective mechanism, FIGS. 7*a* and *b* show idler axle bolt 65 in sliding on carrier rods 69 and 70, which are anchored by pivot pin 71 to frame block 74. Block 74 is fixed to frame 28 and provides a support base for pivotal adjustment. At the opposing end, carrier rods are attached in pivotal coupling with camber block 76 through 72. Lateral movement of camber block 76 is controlled with adjustor screw 77 which is contained, in fixed plane rotation, by snap ring 81 running spotface 82 of adjustor block 79. Adjustor screw 77 engages block 76 in threaded fashion so that rotation of the adjustor screw produces camber tilt to the reciprocating carrier block 66 and ultimately to idler wheel 63 through axle bolt 65. Camber adjustment is essential for effective belt tracking.

V-linkage 85 transmits the reciprocal movement of carrier block 66 to wheel shield 86 and pivot arm 91, which is anchored in rotational orientation to frame 28 by shoulder bolt 93. Idler wheel tension is determined by adjusting thumb wheel 99, which threads through boss 98 to exert spring (96 and 97) modulated pressure on connector bar 104 at tensioner angle 94. Terminal shoulder bolts 91 and 103 attach connector bar 104 to pivot arms 91 and 101, respectively, to provide articulation between those terminals. Offset bar 108 is attached at its terminal ends to pivot arm 101 and carrier block 68 by shoulder bolts 106 and 107 respectively. Bar 108 completes the linkage between the carrier blocks. Block 68 supports idler axle bolt 67 and idler wheel 64. It also carries wheel shield 122 and telescoping tool post 128.

Figure 9B:
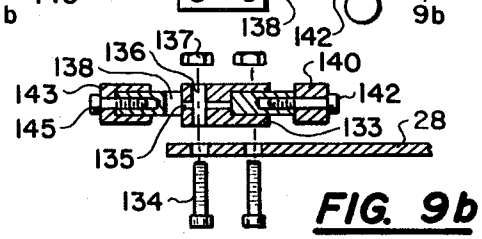
FIG. 9*b* is a partially sectioned view taken along lines B—B' of FIG. 9*a;*

The drive wheel assembly is illustrated in FIGS. 9*a–c*. It is designed to provide stepped release of abrasive belt. Partial rotation of step cam 151 effects a loosening of the abrasive belt to permit belt exchange. Further rotation to the second step permits step pulley speed changes. The operation of cam 151 is initiated with cam handle 157. Step cam 151 is secured, in rotational orientation, to frame 28 through crank support 35 and frame bore 154. Clockwise rotation of cam 151 releases pressure on cam block 140. Spring 149 acts to extend cam block 140 and pull telescoping rods 138 and 139 and axle block 143 toward the cam. Frame block 133, through which the rods pass, is fixed to frame 28 and serves to support the entire sliding assembly. A partially sectioned view of FIG. 9*a*, taken along lines B-B′ indicates that block 133 is secured to frame 28 by representitive capscrew 134, which is threaded to the kerf of the block and clearance drilled through the remainder of the block 136. This structure permits locknut 137 to compensate for wear on the telescoping rods by adjusting pinching tension at kerf 135. Axle housing 159 is welded to axle block 143. The housing rotatably supports drive axle 162, drive wheel 61, step pulley 165, and split clamp 183. Step pulley 165 is connected by V-belt 168 to drive step pulley 169 as illustrated in FIG. 8. In that figure step pulley 169 is shown attached motor shaft 170. The C-face drive motor is laterally adjustable in four slots, represented by slot 181 and is held in place by four capscrews 182. This adjustment permits proper tensioning of V-belt 168. Housing cover 210 with hinge 211 and thumbscew 212 serve to enclose the drive components.

Referring now to FIG. 9*c*, it is observed that split clamp 183, which supports the contour rest assembly, is mounted on axle housing 159 between two snap rings, 184 and 185. It is adjustable to provide rotation on the axle housing, but can be locked in place with sleeve 186 and capscrew 190.

Rest clamp 191 receives sleeve 186 and tool post 192 in sliding fit permitting rotation of reciprocal adjustment of the rest. Capscrew 193 functions to lock all adjustments in fixed position. Contour work rest 197 is welded to post 192 to complete the assembly.

FIGS. 11*a–c* illustrate the flexibility of adjustment for contour rest 197. In 11*a*, the rest offers horizontal contact belt work. In 11*b*, the rest doubles as a full guard and in 11*c*, the rest is adjusted vertical angle grinding.

The adjustment standards for long work table 47 are shown in FIG. 2. Standards 39 and 40 provide support platen 45 and long work table 47 and are slot adjustable to achieve belt/platen alignment. Capscrews 41 and 42 pass through slots 43 and 44 (see FIG. 3*b*) to thread into the standards. In FIG. 2, long table brackets 48 and 49 are slotted to permit table adjustment with standards. Capscrews 50 and 51 fix the table in a selected position. FIG. 12*b* shows table 47 with full belt exposure, FIG. 12*c* illustrates the table with diagonal belt exposure and FIG. 12*a* demonstrates the full guard option.

The telescoping interface of tool post 128 with carrier block 68 is illustrated in FIG. 8. Its relative rotation of sliding orientation is fixed with capscrew 129. Workrest 132 is adngle adjustable through the axis of capscrew 130, which serves to join the work rest with tool post 128. The versatility of this rest is demonstrated in FIG. 8, wherein workrest 132 is angle adjustable in the vertical plane and in FIG. 12*b*, where the workrest 132 is shown in horizontal, full belt position. FIG. 12*a* indicates the full guard option.

Other unique features that relate to workrests and platens are taught in the present invention. Shown in FIGS. 10*a* and 10*b*, is an integral system for cooling long platen 45 during friction producing grinding operations. Serrated drive wheel 62 is equipped with standard 45 degree helical lands which in running interface with abrasive belt 61, produce a high pressure area at point 198. In the present machine that pressure is utilized to provide air flow through special tubular platen 45, illustrated at 199.

The dust collection system integrated with long work table 47 is illustrated in FIG. 2. Interior vents 213 are positioned in the belt facing edge of the table to collect waste products in a lineal fashion along the entire length of the table. These waste products are collected by exhaust line 214. The ends of long work table 107 may be closed with a cap 215 or left open to collect dust from lateral operations. Extending from the table is exhaust line 214 and it enters cabinet 216 at orifice 217. An interior vacuum motor (not shown) provides the dust removing power source.

Also shown in FIG. 8 is power lead 218 which extends from cabinet switch 219 through orifices 220 and 221 (see FIG. 2) to drive motor 180.

Enclosing all the components is machine head cover 222 shown in FIGS. 1*a–c* which is attached by capscrews to frame cover tabs 37 and 38 and crank support 35.

What is claimed is:

1. A belt grinder comprising:

a base, a pair of longitudinally spaced support members extending upwardly from said base, said support members having aligned apertures in them that define a major longitudinal pivot axis;

a power train housing positioned between said upwardly extending support members, said housing having an axis of rotation;

means for pivotally mounting said housing to said upwardly extending support members with the axis of rotation of said housing being in alignment with said major longitudinal pivot axis of said support members;

a machine head assembly having a bottom frame that is attached to the top of said housing, a drive wheel and at least two idler wheels supported at predetermined spaced positions on the top surface of said bottom frame member, a closed loop abrasive belt passing around the outer periphery of said drive and idler wheels, said drive wheel and two idler wheels defining a belt line geometry that determines the path for said closed loop abrasive belt to pass from said drive wheel to a first one of said idler wheels, from one of said idler wheels to another of said idler wheels, and from said another of said idler wheels to said drive wheel said belt lines between said drive wheel and said idler wheels forming an angle there between:

means for maintaining said angle substantially constant while said belt line between said idler wheels moves substantially parallel to its starting position during adjustments of said idler wheels nearer to and farther from said drive wheel responsive to decreases and increases in the length of said closed loop abrasive belt due to stretching and changing temperatures;

means for pivoting said power train housing substantially through 360 degrees; and means for locking said power train housing at predetermined positions throughout its 360 degree range of pivotal motion.

2. A belt grinder as recited in claim 1 wherein said power train housing has a primary longitudinal axis and this is angularly offset from its axis of rotation by a predetermined angle.

3. A belt grinder as recited in claim 1 wherein said closed loop abrasive belt has an open throat work station, a contact wheel work station, and a long platen work station and these stations are operable when said machine head assembly is in any one of a horizontal and two vertical positions.

4. A belt grinder as recited in claim 1 wherein said means for pivotally mounting said housing to said upwardly extending support members further comprise a counterbalance mechanism to aid in pivoting said housing through its 360 degree range of travel.

5. A belt grinder as recited in claim 1 further comprising a drive motor located within said machine head assembly having a V-shaped drive belt.

6. A belt grinder as recited in claim 5 wherein said drive motor has a drive shaft that extends into said power train housing and it has a step pulley mounted thereon, said drive wheel in said machine head assembly also has a drive shaft that extends into said power train and it has a step pulley mounted thereon, a V-shaped drive belt passes around said respective step pulleys to transmit the rotation motion of said motor drive shaft to said drive wheel.

7. A belt grinder as recited in claim 6 further comprising means for loosening the tension on said V-shaped pulley so that it may be changed or moved to different pulleys on said step pulleys.

8. A belt grinder as recited in claim 5 further comprising a bar slide mechanism and step cam controlled by a single leveraged bar to produce staged release of said abrasive belt and said V-shaped drive belt.

9. A belt grinder as recited in claim 1 further comprising a spring tension mechanism for applying spring tension to both of said idler wheels for reducing slack belt slap at the trailing edge of said drive wheel.

10. A belt grinder as recited in claim 1 wherein said means for maintaining said angle constant and moving said belt line between said idler wheels parallel comprises said idler wheels each having supported on a slide mount and articulated connective linkage between said respective slide mounts coordinating reciprocating movement thereof, for allowing said adjustments of said idler wheels.

11. A belt grinder as recited in claim 10 further comprising a belt tracking mechanism capable of transmitting camber adjustments to one of said idler wheels.

12. A belt grinder as recited in claim 1 further comprising work rests and guards that attach to and have synchronous movement with the structure mounting said respective drive wheel and idler wheels.

13. A belt grinder as recited in claim 1 further comprising multiple position work rests that can support a workpiece in a vertical orientation and also in a horizontal orientation and which are adjustable to fully guard a work station not being used.

14. A belt grinder as recited in claim 1 further comprising a long platen mounted on the top of said bottom frame at a long platen work station and having means to ventilate said long platen to reduce frictional heat buildup.

15. A belt grinder as recited in claim 1 further comprising a cover member hinged to the bottom of said power train housing.

* * * * *